US006491432B2

(12) United States Patent
May

(10) Patent No.: US 6,491,432 B2
(45) Date of Patent: Dec. 10, 2002

(54) RESEALABLE CLOSURE MECHANISM HAVING A SLIDER DEVICE AND METHODS

(75) Inventor: Timothy J. May, Greenville, WI (US)

(73) Assignee: Reynolds Consumer Products, Inc., Richmond, VA (US)

( * ) Notice: Subject to any disclaimer, the term of this patent is extended or adjusted under 35 U.S.C. 154(b) by 0 days.

(21) Appl. No.: 09/726,065

(22) Filed: Nov. 29, 2000

(65) Prior Publication Data

US 2002/0064322 A1 May 30, 2002

(51) Int. Cl.[7] ..... B65D 33/16
(52) U.S. Cl. ..... 383/64; 24/400; 24/427
(58) Field of Search ..... 383/64; 24/399, 24/400, 427, 428

(56) References Cited

U.S. PATENT DOCUMENTS

| | | | | | |
|---|---|---|---|---|---|
| 3,220,076 | A | | 11/1965 | Ausnit et al. | |
| 3,426,396 | A | | 2/1969 | LaGuerre | |
| 3,713,923 | A | * | 1/1973 | Laguerre | 156/66 |
| 3,806,998 | A | * | 4/1974 | Laguerre | 24/400 |
| 5,020,194 | A | | 6/1991 | Herrington et al. | |
| 5,063,644 | A | | 11/1991 | Herrington et al. | |
| 5,067,208 | A | * | 11/1991 | Herrington, Jr. et al. | 24/399 |
| 5,442,837 | A | | 8/1995 | Morgan | |
| 5,558,439 | A | * | 9/1996 | Tilman | 24/DIG. 50 |
| 5,638,586 | A | * | 6/1997 | Malin et al. | 24/584.1 |
| 5,664,299 | A | | 9/1997 | Porchia et al. | |
| 6,047,450 | A | * | 4/2000 | Machacek et al. | 24/399 |
| 6,112,374 | A | * | 9/2000 | Van Erden | 24/389 |
| 6,305,844 | B1 | * | 10/2001 | Bois | 24/399 |

* cited by examiner

*Primary Examiner*—Stephen P. Garbe
(74) *Attorney, Agent, or Firm*—Tracey D. Beiriger

(57) ABSTRACT

A slider device is disclosed for use with a resealable package. The slider device includes structure for preventing or minimizing the likelihood that the slider device can be removed from the resealable package. In one embodiment, the slider device includes a top wall and first and second sidewalls depending from the top wall. The first sidewall has a barb member extending inwardly toward the first closure profile of the resealable closure mechanism. The barb member is constructed and arranged to engage the first closure profile in response to a pulling force on the slider device away from the resealable closure mechanism. In another embodiment, the first sidewall also includes a hook construction defining a flange to slidably cover a shoulder of the first closure profile. The hook construction and flange define an offset that is constructed and arranged to engage the shoulder of the first closure profile in response to a pulling force on the slider device away from the resealable closure mechanism. In yet another embodiment, the second sidewall defines a slide channel for receiving a tongue member cantilevered from the second closure profile. A spreader for separating the first and second closure profiles biases the tongue member towards the slide channel such that said tongue member is captured within said slide channel when said slider device is being removed from said resealable closure mechanism.

22 Claims, 8 Drawing Sheets

RESEALABLE CLOSURE MECHANISM HAVING A SLIDER DEVICE AND METHODS

FIELD

This disclosure generally relates to closure arrangements for polymer packages, such as, plastic bags. In particular, this disclosure relates to closure arrangements having resealable profiles and slider devices to open and close the profiles.

BACKGROUND

Many packaging applications use resealable containers to store or enclose various types of articles and materials. These packages may be used to store food products, non-food consumer goods, medical supplies, waste materials, and many other articles. Resealable packages are convenient in that they can be closed and resealed after the initial opening to preserve the enclosed contents. The need to locate a storage container for the unused portion of the products in the package is thus avoided. In some instances, providing products in resealable packages appreciably enhances the marketability of those products.

Some types of resealable packages are opened and closed using a slider device. The slider device typically includes a separator or spreader-type structure at one end that opens a closure mechanism, having profiled elements or closure profiles, when the slider device travels in a first direction along the mechanism. The sidewalls of the slider device are configured so that the sidewalls engage the closure profiles and progressively move them into engagement to close the resealable package when the slider device is moved along the closure mechanism in a direction opposite the first direction. Moreover, the slider device typically includes a system that allows the slider to slide along the resealable closure mechanism without becoming disengaged from the resealable package. However, existing slider devices have shortcomings that limit their usefulness.

For example, many slider devices can be easily removed from the resealable, flexible package by the user with very little effort. However, in many applications, it is typically undesireable for the slider device to be removed from the flexible package. Furthermore, once the slider device is removed from the package, it is typically difficult for the user to replace on the package.

Improvements in the design and manufacture of closure mechanisms and slider devices are desirable.

SUMMARY OF THE DISCLOSURE

In general terms, this disclosure relates to resealable closure mechanisms having slider devices operably mounted thereon for selectively opening or closing the resealable closure mechanism. A slider device is disclosed for use with a resealable closure mechanism having a first closure profile and a second closure profile. The slider device includes structure for preventing or minimizing the likelihood that the slider device can be removed from the resealable package.

In one aspect, the slider device includes a top wall and first and second sidewalls depending from the top wall. The first sidewall has a barb member extending inwardly toward the first closure profile of the resealable closure mechanism. The barb member is constructed and arranged to engage the first closure profile in response to a pulling force on the slider device away from the resealable closure mechanism.

In another aspect, the first sidewall also includes a hook construction defining a flange to slidably cover a shoulder of the first closure profile. The hook construction and flange define an offset that is constructed and arranged to engage the shoulder of the first closure profile in response to a pulling force on the slider device away from the resealable closure mechanism.

In yet another aspect, the second sidewall defines a slide channel for receiving a tongue member cantilevered from the second closure profile. A spreader for separating the first and second closure profiles biases the tongue member towards the slide channel such that the tongue member is captured within the slide channel when the slider device is being removed from the resealable closure mechanism.

The disclosure also concerns a reclosable zipper arrangement. In one embodiment described, the zipper arrangement includes a first closure profile defining a first closure member having a locking finger, a first upper flange, a guide post extending from the first upper flange, and a first catch extending from the first upper flange opposite the guide post. The zipper arrangement also includes a second closure profile defining a second closure member having a second catch, a second upper flange, and a tongue member cantilevered from the second upper flange. A slider device is disclosed for use with the zipper arrangement. The first and second closure profiles engage or interface with structure of the slider device structure for preventing or minimizing the likelihood that the slider device can be removed from the zipper arrangement.

In one aspect, a first sidewall of the slider device includes a barb member extending inwardly toward the first closure profile. The barb member is constructed and arranged to engage the first closure profile in response to a pulling force on the slider device away from the resealable closure mechanism. In particular, the barb member engages the first catch extending from the first upper flange opposite the guide post in response to a pulling force on the slider device away from the resealable closure mechanism.

In another aspect, the first sidewall of the slider device also includes a hook construction defining a flange to slidably cover the shoulder of the first closure profile. The hook construction and flange define an offset that is constructed and arranged to engage the first closure profile in response to a pulling force on the slider device away from the resealable closure mechanism. In particular, the hook construction and flange define an offset that engages the shoulder of the first closure profile in response to a pulling force on the slider device away from the resealable closure mechanism.

In yet another aspect, the second sidewall of the slider device defines a slide channel for receiving a portion of the second closure profile. In particular, the slide channel receives the tongue member cantilevered from the second closure profile. The tongue member is biased towards the slide channel such that the tongue member is captured within the slide channel when the slider device is being removed from the resealable closure mechanism.

Methods of using a resealable package are described. Methods include a step of moving a slider device as described above along a mouth of the package in a first direction to close the package. Furthermore, the method also includes the step of moving the slider device along the mouth of the package in a second direction to open the package.

A method of removing a slider device as described above from the resealable zipper is also disclosed. The method includes the step of pulling the slider device away from the resealable zipper to remove the slider device from the resealable zipper and engaging a barb member with a first closure profile of the resealable zipper to oppose the removal force.

DETAILED DESCRIPTION

Figure 1:
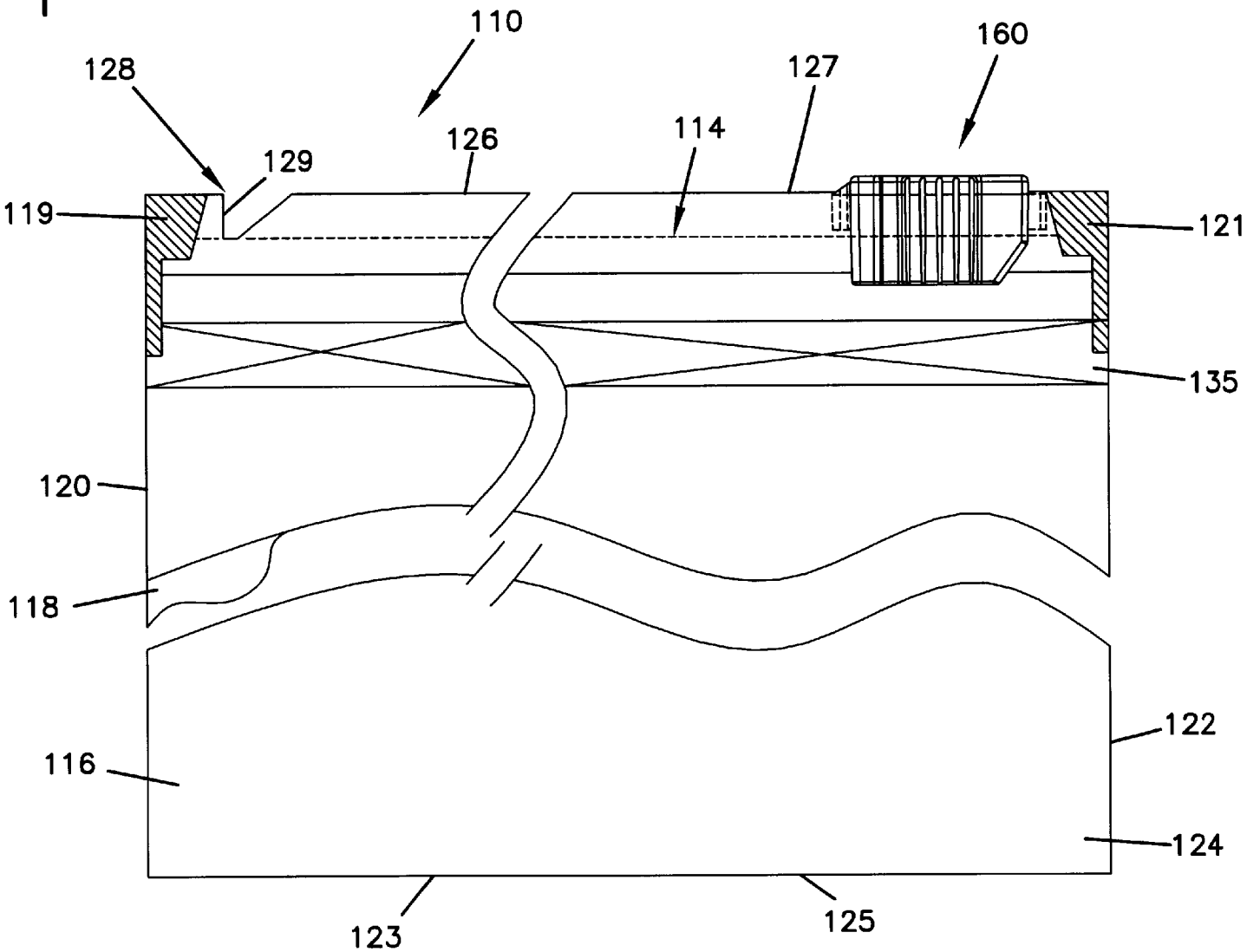
FIG. 1 is a side elevational, schematic view of a flexible, resealable package having a slider device, according to principles of this disclosure.

Attention is directed to FIG. 1. FIG. 1 illustrates an example packaging arrangement in the form of a resealable, flexible package 110, for example, a polymeric package such as a plastic bag, having a resealable closure mechanism 114, for example, interlocking profiled elements, constructed in accordance with the principles of this disclosure. The flexible package 110 includes first and second opposed panel sections 116, 118, typically made from a flexible, polymeric, plastic film. With some manufacturing applications, the first and second panel sections 116, 118 are heat-sealed together along two side edges 120, 122 and meet at a fold line 123 in order to form a three-edged containment section for a product within an interior 124 of the package 110. In the embodiment shown, the fold line 123 comprises the bottom edge 125 of the package 110. Alternatively, two separate panel sections 116, 118 of plastic film may be used and heat-sealed together along the two side edges 120, 122 and at the bottom edge 125. Access is provided to the interior 124 of the package 110 through a mouth 126 at a top edge 127 of the package. In the particular embodiment shown, the mouth 126 extends the width of the package 110.

The resealable closure mechanism 114 is illustrated in FIG. 1 at the mouth 126 of the flexible package 110. In the embodiment shown, the resealable closure mechanism 114 extends the width of the mouth 126. Alternatively, the closure mechanism 114 could be positioned on the package 110 at a location different from the mouth 126 of the package 110, depending on the application needs for the package 110. The resealable closure mechanism 114 can be one of a variety of closure mechanisms. In the particular embodiment illustrated in FIG. 2, the resealable closure mechanism 114 is shown in the specific form of a zipper-type closure mechanism. By the term "zipper-type closure mechanism," it is meant a structure having opposite interlocking or mating profiled elements that under the application of pressure will interlock and close the region between the profiles. Preferably, the zipper-type closure mechanism is not a rolling action type zipper. That is, preferably the closure is not one that closes by movement from a 6 o'clock position to a 12 o'clock position. It is noted, however, that slider devices 160 of the types described herein are usable with rolling action type zippers. Preferred zipper-type closure mechanisms described herein close by movement from a 9 o'clock to a 3 o'clock position.

Figure 2:
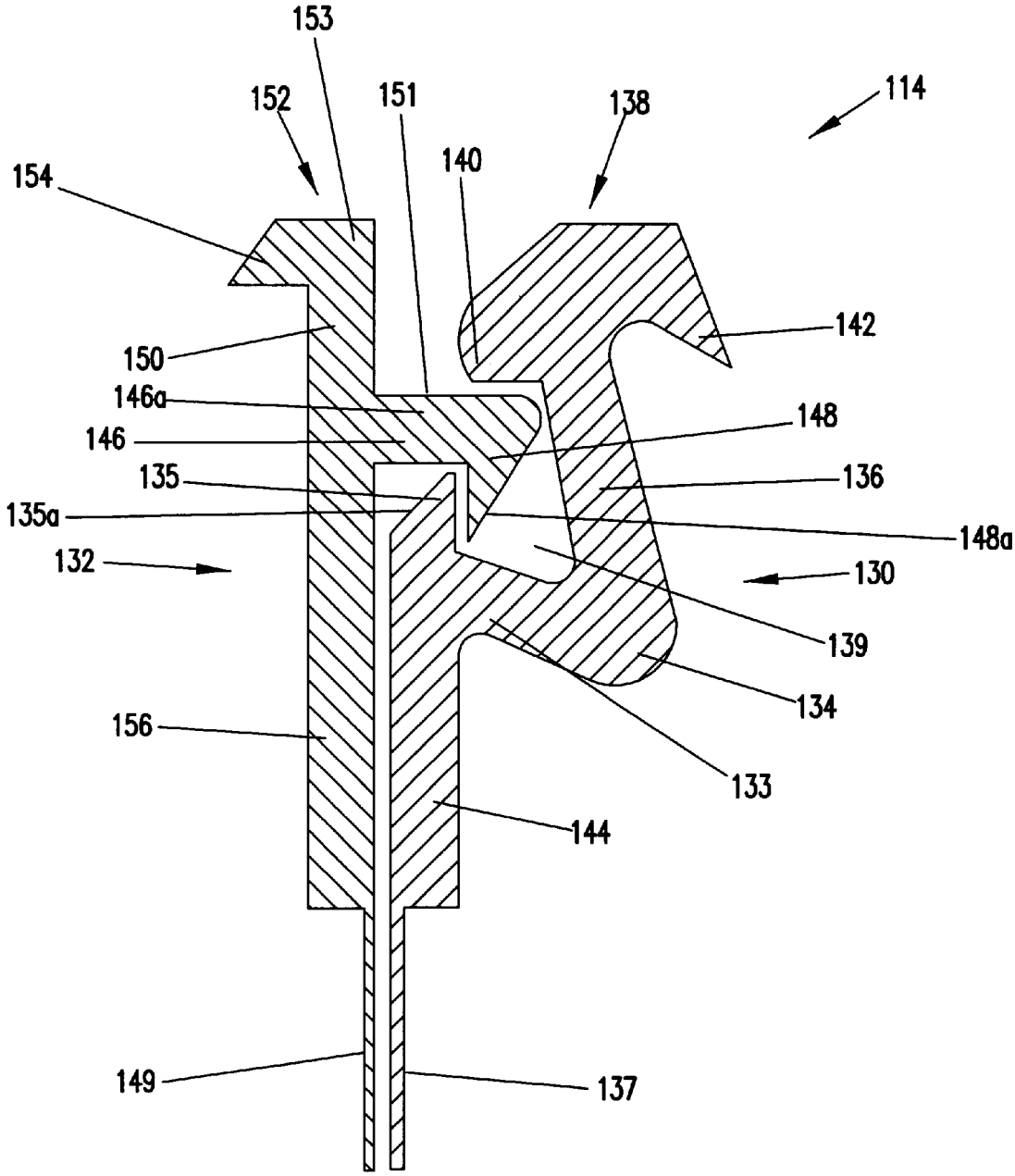
FIG. 2 is a cross-sectional view of an exemplary embodiment of profiled elements usable with the resealable package of FIG. 1, according to principles of this disclosure.

In particular, the zipper-type closure mechanism in FIG. 2 is an illustration of one example of a closure mechanism 114. The closure mechanism 114 includes an elongated first closure profile 130 and an elongated second closure profile 132. In the illustrated embodiment, the first closure profile 130 includes a sealing flange or bonding strip 137, a base strip 144, a closure member 133, and an upper flange 136. The closure member 133 extends from the base strip 144 and includes a locking finger 135 extending upwardly from and substantially parallel to the base strip 144. By "upwardly," it is meant that in the orientation as shown in FIG. 2, the locking finger 135 extends above the closure member 133 and the base strip 144. At the free end of the upper flange 136 is a guide member 140 extending towards the second closure profile 132. The guide member 140 aids in holding the closure mechanism 114 closed and in aligning the first closure profile 130 with the second closure profile 132 for interlocking. A hook or catch 142 extends from the upper flange 136 opposite the guide member 140. The catch 142 aids in preventing or minimizing the slider device 160 from being removed from the resealable closure mechanism 114 as will be discussed in greater detail below. The bonding strip 137 depends or extends downward from the base strip 144 and can be attached to a first panel section, such as the first panel section 116 of the package 110 of FIG. 1 at region 131 (FIG. 1). An elbow or shoulder 134 is defined by the intersection of the closure member 133 and the upper flange 136. In the example illustrated, the upper flange 136 is spaced a distance laterally from the sealing flange 144 to define a corner forming the shoulder 134.

In the illustrated embodiment, the second closure profile 132 includes a sealing flange or bonding strip 149, a closure member 146, and an upper flange 150. The closure member 146 extends from the base strip 156 by way of a stem **146*a* and is generally projecting from the base strip 156. At a free end of the stem 146*a* (or tip of the closure member 146) is a hook or catch 148. The upper surface 151 of the closure member 146 aids in holding the closure mechanism 114 closed and aids in aligning the second closure profile 132 with the first closure profile 130 for interlocking. The bonding strip 149 depends or extends downward from the base strip 156 and can be attached to a second panel section, such as the second panel section 118 of the package 110 of FIG. 1. A tongue member 154 is cantilevered from the free end 152 of the second upper flange 150. The tongue member 154 extends from the upper flange 150 about substantially perpendicular to the upper flange 150. As a result, an "L-shaped" region 153 is defined by the intersection of the tongue member 154 and the upper flange 150. The "L-shaped" region 153 aids in preventing or minimizing the slider device 160 from being removed from the resealable closure mechanism 114** as will be discussed in greater detail below.

The first and second closure profiles 130, 132 are designed to engage with one another to form the resealable closure mechanism 114. The closure member 133 of the first closure profile 130 extends from the base strip 144 a first distance. The closure member 146 of the second closure profile 132 also extends from the base strip 156 a first distance. These first distances that the closure members 130, 132 extend are sufficient to allow mechanical engagement, or interlocking, between the closure member 133 of the first closure profile 132 and the closure member 146 of the second closure profile 132. Moreover, as can be seen in FIG. 2, the first closure profile 130 defines a locking region 139 for hooking or engaging the closure member 146 of the second closure profile 132. In particular, the hook or catch 148 of the second closure profile 132 is allowed to hook or engage the locking finger 135 of the first closure profile 130. Furthermore, the closure profiles 130, 132 can be sealed together at their ends, such as regions 119, 121 of FIG. 1, to further aid in aligning the closure profiles 130, 132 for interlocking through processes such as ultrasonic crushing.

The openable sealed closure mechanism 114 is formed by forcibly engaging the first closure profile 130 with the second closure profile 132. In particular, the resealable closure mechanism 114 is sealed by pushing the closure member 146 of the second closure profile 132 into engagement with the locking finger 135 of the closure member 133 of the first closure profile 130. In so doing, the hook or catch 148 is able to latch or interlock with the locking finger 135. Furthermore, the guide member 140 biases the closure member 146 of the second closure profile 132 into engagement with the closure member 133 of the first closure profile. Conversely, the resealable closure mechanism 114 can be opened by forcibly disengaging the first closure profile 130 from the second closure profile 132. In particular, the hook or catch 148 can be pulled out of engagement with the locking finger 135 of the first closure member 130 such that the first closure member 130 disengages from the second closure member 132, thereby, opening the package 110 of FIG. 1. This provides access to the contents of the package 110 through the mouth 126 (FIG. 1).

In some applications, the closure profiles 130, 132 are formed by two separate extrusions or through two separate openings of a common extrusion. Typically, the resealable closure mechanism 114 is made of conventional materials, such as a polymeric, plastic material, for example, polyethylene or polypropylene. In one example embodiment, the closure arrangement illustrated in FIG. 2 is manufactured using conventional extrusion and heat sealing techniques.

Attention is again directed to FIG. 1. In FIG. 1, note that there can be a cutout or notch 128 formed in the upper flanges 136, 150 (FIG. 2) of the resealable closure mechanism 114. As a result, the notch 128 can serve as a "parking place" for a slider device 160 and also facilitates mounting the slider device 160 onto the resealable package 110 during initial assembly. In addition, the edge 129 closest to the side seal 120 helps to create a stop member for the slider device 160. The notch 128 decreases the tendency for an incomplete interlock between the first closure profile 130 and the second closure profile 132.

Still referring to FIG. 1, the slider device 160 is provided to open and close the resealable closure mechanism 114. The slider device 160 is constructed and arranged to engage or interface with the resealable closure mechanism to selectively open or close the flexible package 110. By "engage," it is meant that the top and sidewalls of the slider device 160 can apply pressure to interlocking or mating profiled elements of the resealable closure mechanism 114 that will interlock and close the region between the profiles. Similarly, the top and sidewalls of the slider device 160 can apply pressure to interlocking or mating profiled elements of the resealable closure mechanism 114 that will disengage and open the region between the profiles.

Figure 3:
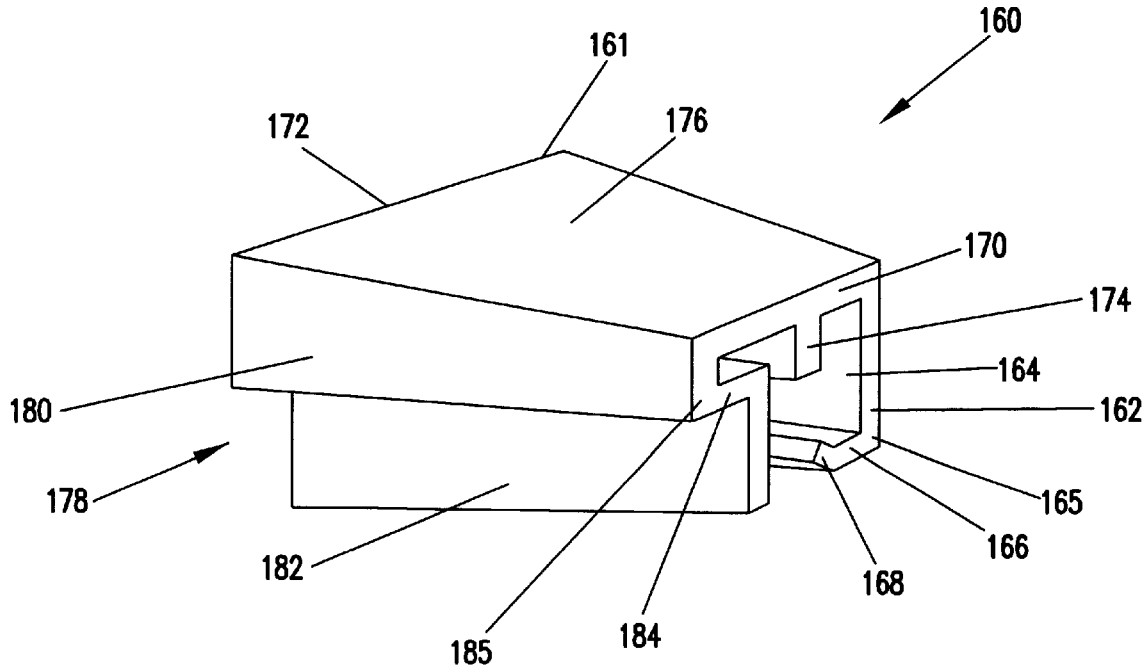
FIG. 3 is an enlarged, top perspective view of one embodiment of the slider device of FIG. 1.
Figure 4:
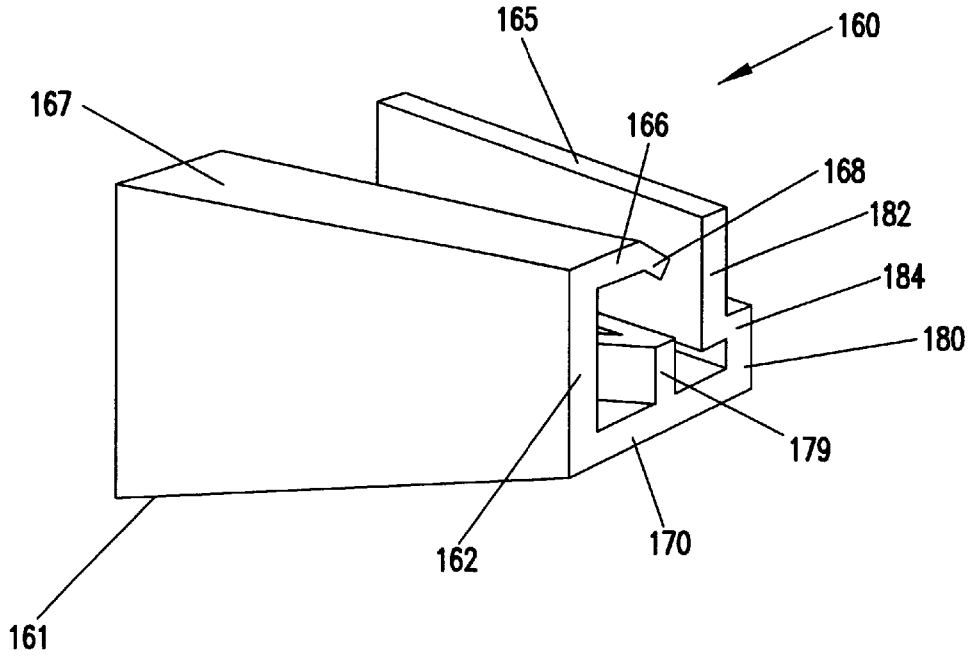
FIG. 4 is an enlarged, bottom perspective view of the slider device of FIGS. 1 and 3.

Referring now to FIGS. 3 and 4, a slider device 160 is described that is operable with the resealable closure mechanism 114 described in connection with FIG. 2. The slider device 160 is illustrated in FIGS. 3 and 4 in perspective view and preferably comprises a one-piece, unitary or monolithic, molded plastic member with no moveable parts that are moveable with respect to one another. In general, the slider device 160 includes a housing 161 for slidably engaging the closure mechanism 114. The housing 161 is movable between a closed position of the resealable package 110 when the housing 161 is adjacent the side edge 120 and an open position of the resealable package 110 when the housing 161 is adjacent the side edge 122. FIG. 1 illustrates the resealable package 110 in an open position. The housing 161 slides over the resealable closure mechanism 114 relative to the top edge 127 of the resealable package 110 to open and close the mouth 126.

The housing 161 is preferably a multi-sided container configured for engaging or locking onto or over the resealable closure mechanism 114. In the particular embodiment illustrated in FIGS. 3 and 4, the housing 161 includes a top wall 176. By the term "top", it is meant that in the orientation of the slider device 160 shown in FIG. 1, the wall 176 is oriented above remaining portions, such as the side walls 162, 178. It should be understood, of course, that if the housing 161 is moved from the orientation shown in FIG. 1, the top wall 176 will not be in a top orientation. The top wall 176 defines a first end 170 and an opposite second end 172.

In reference again to FIGS. 3 and 4, the preferred housing 161 shown also includes first and second sidewalls 162, 178. Preferably, each of the first and second sidewalls 162, 178 extends from and is cantilevered from the top wall 176 to form a region 163 (FIG. 5) therebetween for receiving the resealable closure mechanism 114. In preferred embodiments, the first and second sidewalls 162, 178 are injection molded with the remaining parts of the housing 161. In other words, preferably the housing 161 comprises a single, unitary or monolithic, integral piece of material with no additional materials welded, fastened, or bolted together. Moreover, the sidewalls 162, 178 can include texturization, such as ribs or other similar structure to help improve gripping and handling by the user. In a preferred embodiment, the slider housing 161 has an overall length from the first end 170 to the second end 172 of at least about 0.5 inches (about 13 mm), no greater than about 2 inches (about 51 mm), typically about 0.65–0.75 inches (about 16–19 mm), and in a preferred embodiment about 0.695 inches (about 18 mm).

In the illustrated embodiment, the first and second sidewalls 162, 178 are tapered from a first end 170 of the slider device 160 to a second end 172 of the slider device 160. By "tapered," it is meant that slider device 160 becomes progressively wider from the first end 170 to the second end 172 of the slider device 160. Preferably, the first and second sidewalls 162, 178 of the slider device 160 are configured so that the first and second sidewalls 162, 178 engage the first and second closure profiles 130, 132 and progressively move them into engagement to close the resealable package 110 when the slider device 160 is moved along the closure mechanism 114 in a direction opposite the first direction.

The housing 161 includes a separation structure for separating the first and second closure profiles 130, 132. That is, when the resealable closure mechanism 114 is in a closed state such that the closure members 133, 146 are interlocked, the separation structure will apply a force to wedge open and pull the closure members 133, 146 apart from each other when the slider device 160 travels in a first direction along the resealable closure mechanism 114.

Figure 6:
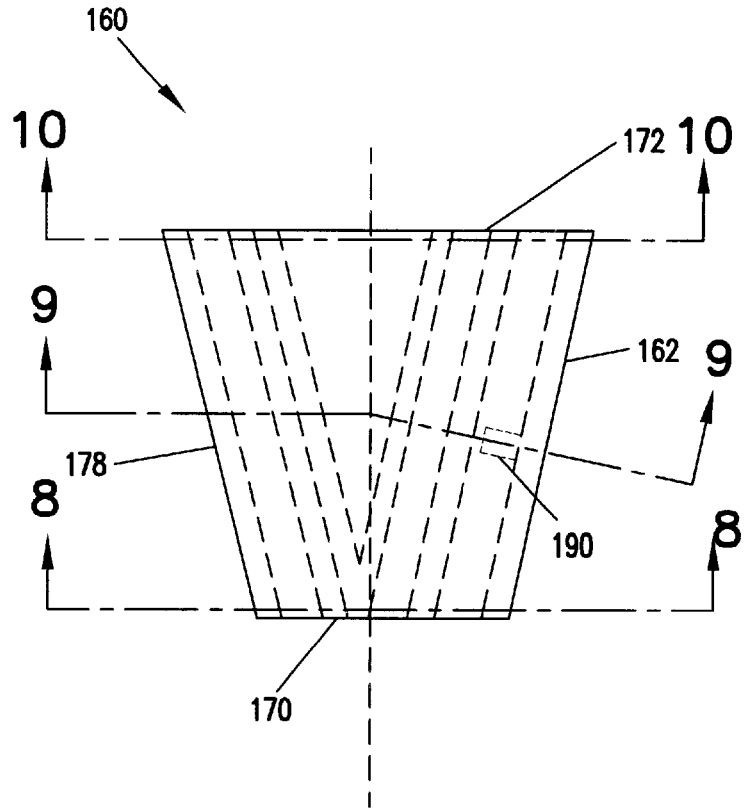
FIG. 6 is an enlarged, top plan view of the slider device of FIGS. 1 and 3.
Figure 7:
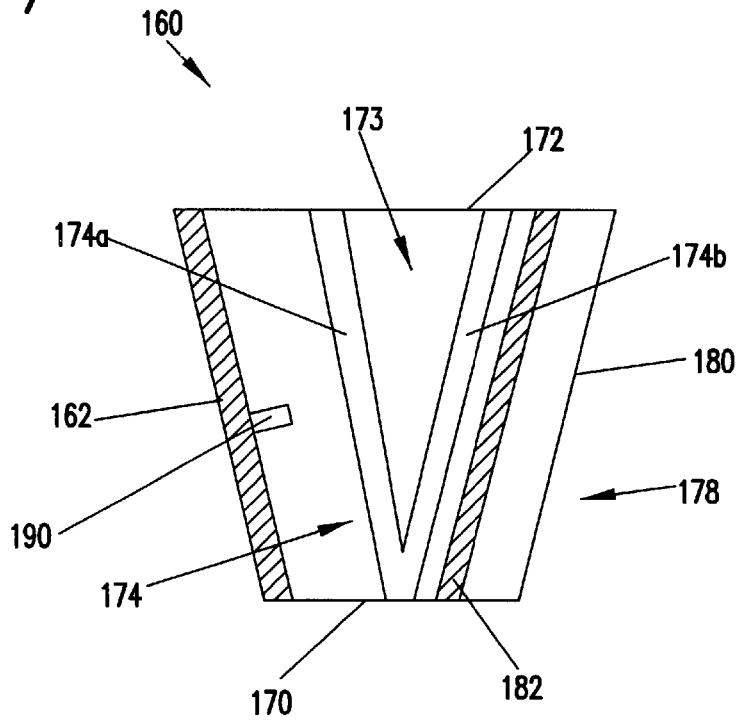
FIG. 7 is an enlarged, bottom cross-sectional view of the slider device of FIGS. 1 and 3 taken along the line 7—7 of FIG. 5.

In the embodiment illustrated, the housing 161 includes a spreader or slider post 174 operating as a separation structure. The spreader 174, in the preferred embodiment shown, extends or depends from the top wall 176. Preferably, the spreader 174 comprises first and second angled wedges 174*a,* 174*b* separated by a gap 173 (FIG. 6) therebetween. As shown in FIG. 7, it can be seen that the first and second wedges 174*a,* 174*b* are angled away from each other, from the first end 170 of the slider device 160 to the second end 172 of the slider device 160. Accordingly, the first and second wedges 174*a,* 174*b* form an overall triangle shaped spreader 174, in plan view, with an apex of the triangle pointing toward the first end 170 of the housing 161. The fist and second wedges 174*a,* 174*b* extend substantially parallel to the first and second sidewalls 162, 178, respectively. The gap 173 between the first wedge 174*a* and second wedge 174*b* helps to contribute to convenient manufacturing techniques for the housing 161, such as injection molding. Preferably, the spreader 174 only extends partially in the resealable closure mechanism 114. More preferably, the spreader 174 only extends between the upper flanges 136, 150 and does not penetrate the closure members 133, 146. This helps to reduce the likelihood of leaks in the closure mechanism 114. In the preferred embodiment shown, the spreader 174 preferably extends downward about 0.125 inches from the inner surface 177 of the top wall 176.

The spreader 174 shown in the illustrated embodiments extends from the first end 170 to the second end 172 of the slider device 160. However, it should be understood that the spreader 174 can be positioned at any suitable location for allowing the spreader to wedge open the first and second closure profiles 130, 132.

Figure 5:
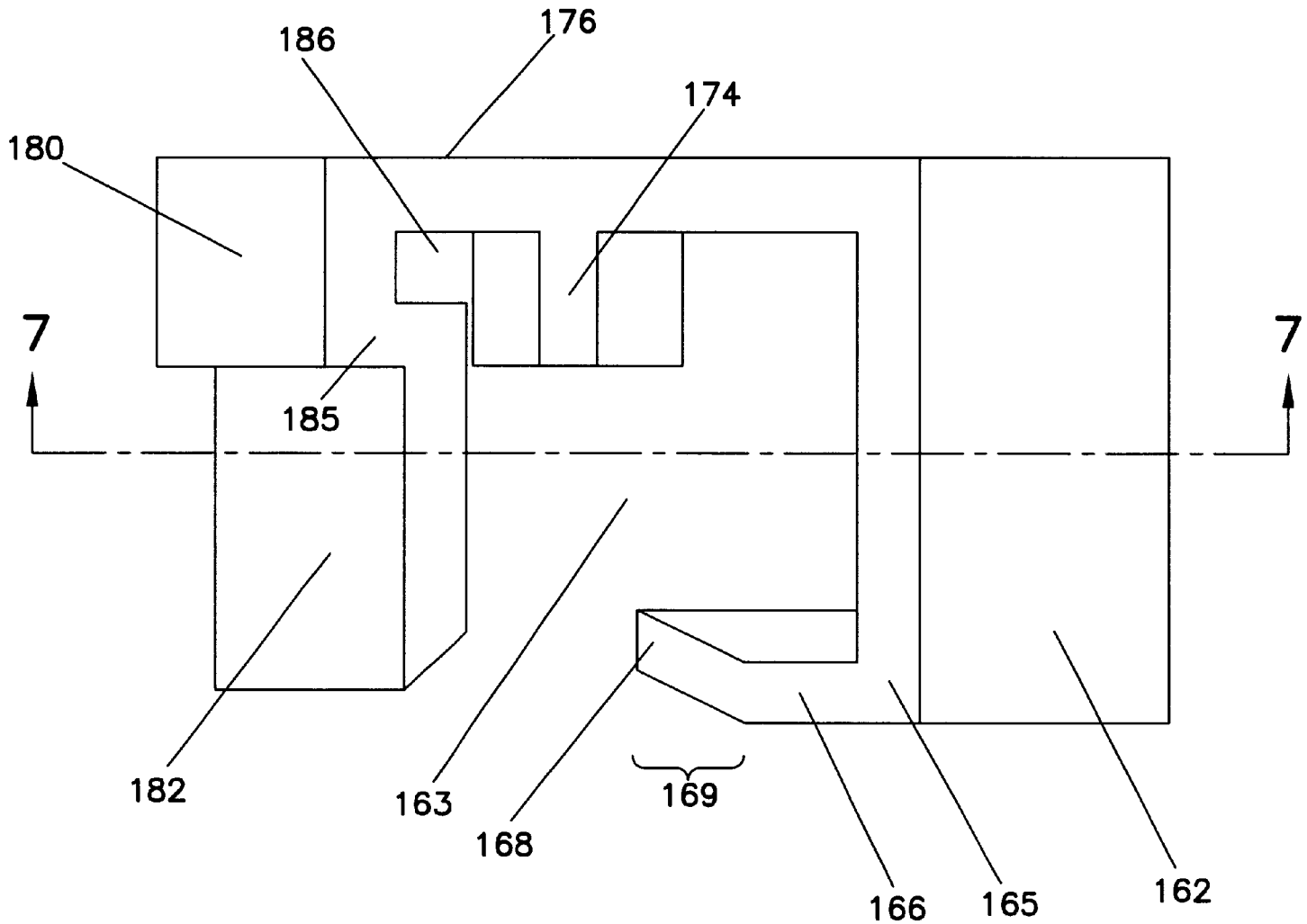
FIG. 5 is an enlarged, front plan view of the slider device of FIGS. 1 and 3.

Preferably, the housing 161 includes a system for permitting the housing 161 to slide along the resealable closure mechanism 114 without becoming disengaged from the resealable package 110. In the embodiment illustrated, the system of the slider housing 161 engages or interlocks with certain structure of the resealable closure mechanism 114. In particular, the housing 161 has a hook construction 165. The hook construction 165 preferably extends from the first sidewall 162 about at or substantially near the distal end of the first sidewall 162. By "distal," it is meant to refer to the portion of the first sidewall 162 farthest from its point of attachment to the top wall 176. As shown in FIG. 5, the hook construction 165 preferably includes a flange 166 in lateral extension from the first sidewall 162. Extending or projecting from flange 166 is a tip 168 oriented toward the top wall 176. As such, the tip 168, in combination with the flange 166, forms a hook or catch for slidable engagement with the shoulder 134 of the first closure profile. Moreover, the intersection of the tip 168 with the flange 166 defines an abrupt change in profile or an offset 169. Accordingly, the offset 169 is constructed and arranged to engage the shoulder 134 in response to a pulling force on the slider device 160 away from said resealable closure mechanism 144. In so doing, the offset 169 helps to reduce likelihood that the slider device 160 can be removed from the resealable closure mechanism 114.

Similarly, the second sidewall 178 is also constructed and arranged for slidable engagement with the second profile member 132. In a preferred embodiment, the second sidewall 178 includes an upper portion 180 and a lower portion 182. The upper and lower portions 180, 182 are joined together by a lateral extension member 184. The lateral extension member 184 is preferably substantially parallel to the top wall 176 of the slider device 160. The intersection of the lateral extension member 184 with the upper portion 180 of the second sidewall 178 defines a shelf or shoulder 185. Accordingly, the second sidewall 178 defines a "L-shaped" region or slide channel 186 (FIG. 5) between the first and second sidewalls 162, 178. In particular, the second sidewall 178 defines a "L-shaped" slide channel 186 between the second sidewall 178 and the spreader 174. The slide channel 186 is constructed and arranged to receive the tongue member 154 cantilevered from the upper flange 150 of the second closure profile 132. In one embodiment, the "L-shaped" slide channel 186 extends away from the lower portion 182 of the slider device 160 at least about 0.08 inches (about 2 mm), no greater than about 0.25 inches (about 6 mm), typically about 0.12–0.20 inches (about 3–5 mm), and in a preferred embodiment about 0.16 inches (about 4 mm).

The slide channel 186 extends along the housing 161 from the first end 170 of the slider 160 to the second end of the slider 160. Preferably, the slide channel 186 is substantially parallel to the second sidewall 178. The tongue member 154, therefore, remains captured or trapped within the slide channel 186 throughout the entire length of the slider device 160. Accordingly, the "L-shaped" slide channel 186 helps to reduce the likelihood that the slider device 160 can be removed from the resealable closure mechanism 114. Furthermore, the shelf or shoulder 185 can improve the gripping and handling of the slider device 160 by the user.

While the preferred embodiment is shown with the second sidewall 178 comprising upper and lower portions 180, 182, it will be appreciated that the second sidewall 178 can be constructed such that it forms a single wall portion without the shelf or shoulder 185. Thus, the "L-shaped" slide channel 186 can be formed in the sidewall 178 to receive and capture the tongue member 154.

Figure 8:
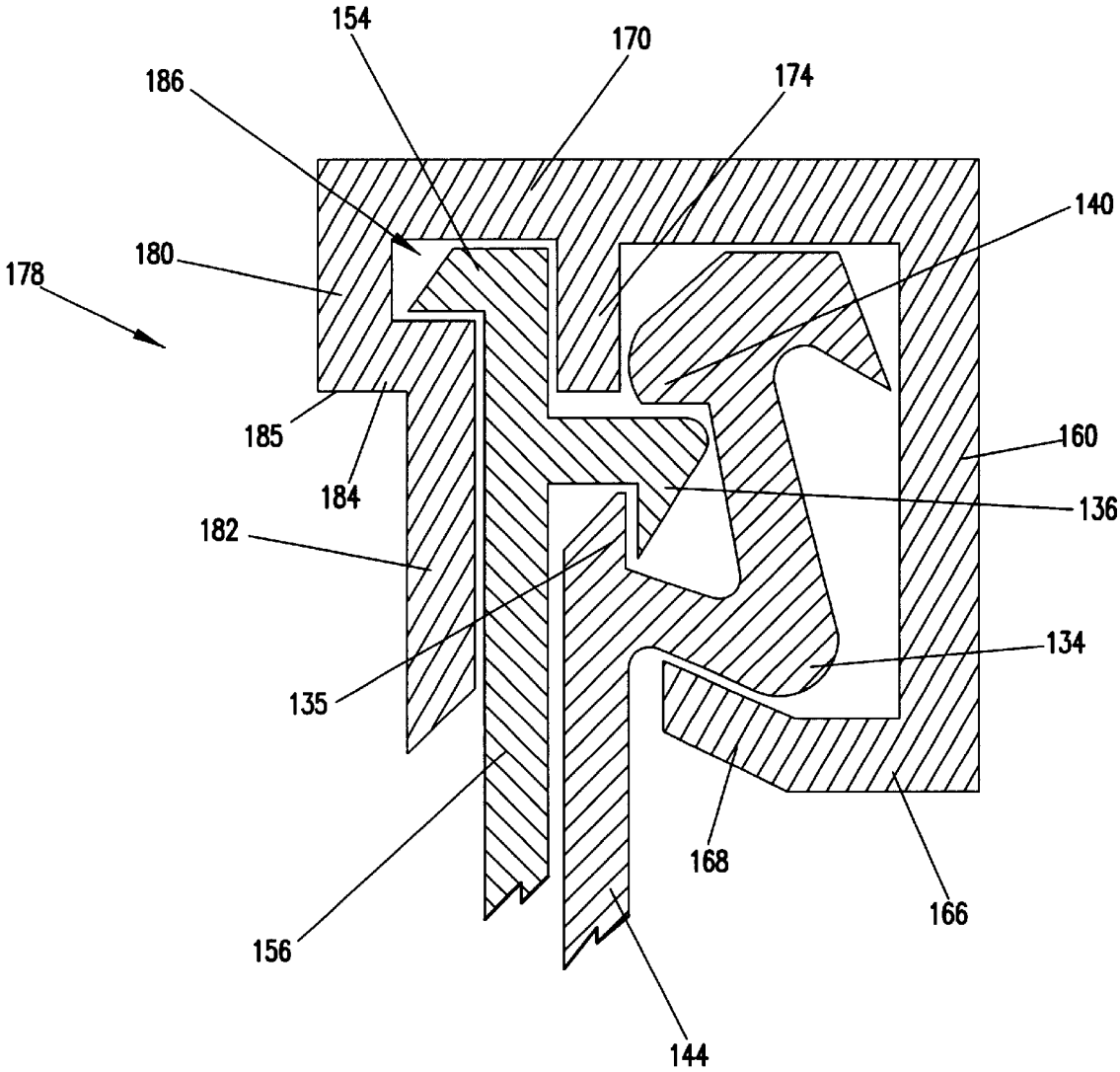
FIG. 8 is an enlarged, cross-sectional view of the slider device of FIGS. 1 and 3 taken along line 8—8 of FIG. 6.
Figure 9:
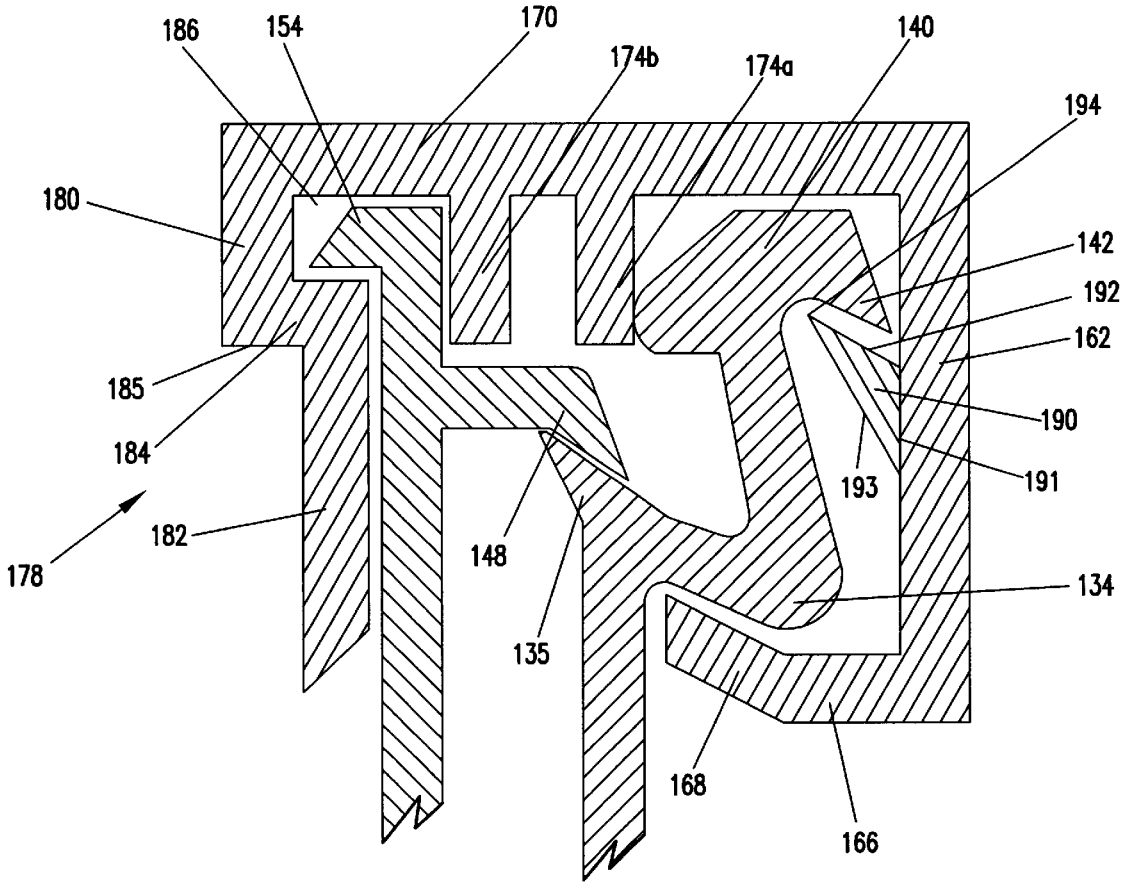
FIG. 9 is an enlarged, cross-sectional view of the slider device of FIGS. 1 and 3 taken along line 9—9 of FIG. 6.
Figure 10:
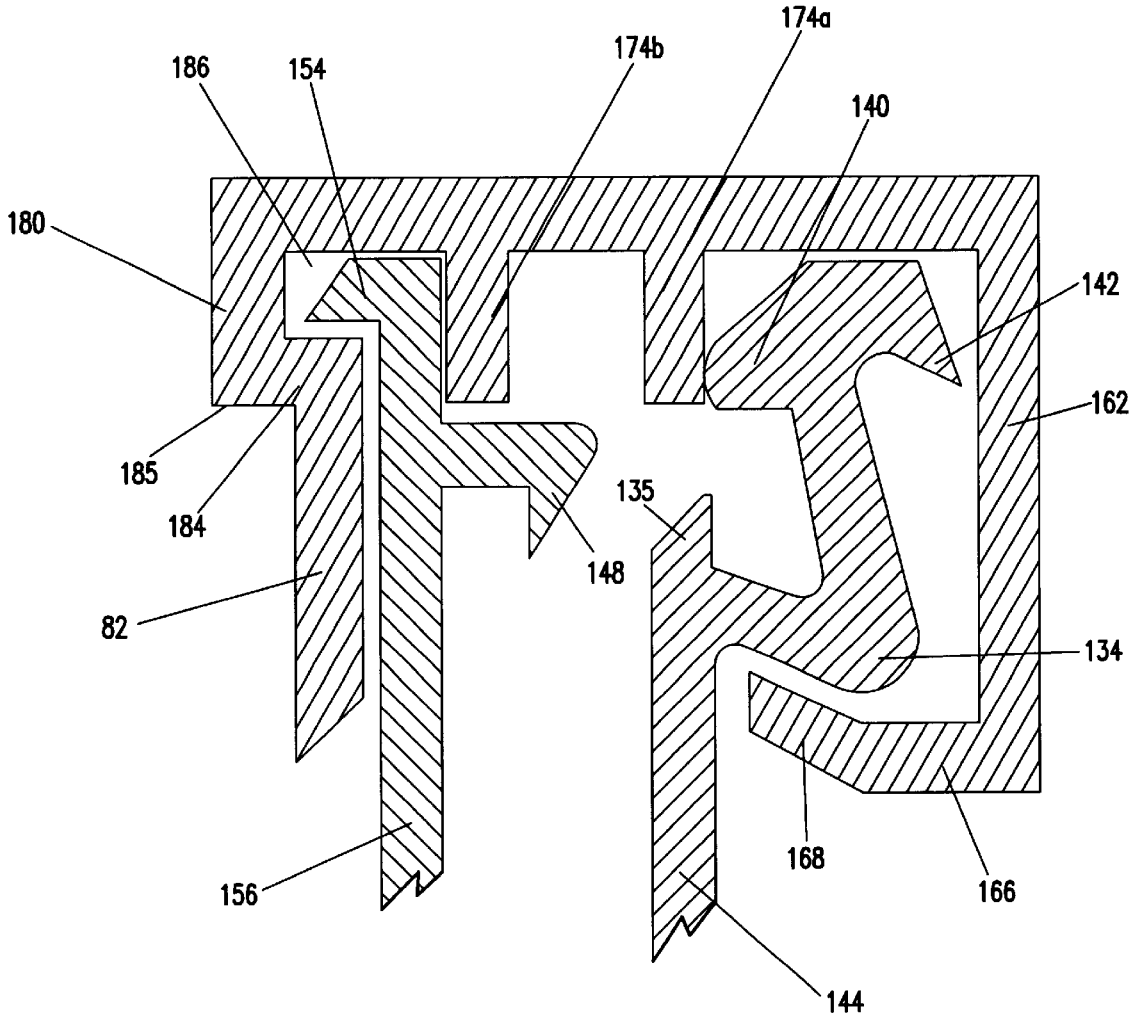
FIG. 10 is an enlarged, cross-sectional view of the slider device of FIGS. 1, and 3 taken along line 10—10 of FIG. 6.

In operation, the slider device 160 is slid relative to the resealable closure mechanism 114 from the closed position adjacent to the side edge 120 to the open position adjacent to the side edge 122. FIGS. 8 through 10 illustrate various cross-sections of the slider device 160 operably mounted on the resealable closure mechanism 114. For example, as the slider device 160 is moved from the open position to the closed position, the first side 162 engages the first closure profile 130 and biases the first closure profile 130 in a direction towards the second closure profile 132. Similarly, the second sidewall 178 engages the second closure profile 132 and biases the second closure profile 132 in a direction towards the first closure profile 130. In particular, the lower portion 182 of the second sidewall 178 engages the base strip 156 as shown in FIG. 8 and biases the second closure profile 132 into engagement with the first closure profile 130.

To facilitate engagement between the closure member 133 of the first closure profile 130 and the closure member 146 of the second closure profile 132, the leading edge 148*a* (FIG. 2) of the hook or catch 148 can be chamfered or angled. Similarly, the leading edge 135*a* of the locking finger 135 can also be chamfered or angled. As a result, the leading edge 148*a* (FIG. 2) of the hook or catch 148 aids the closure member 146 in slidably engaging and interlocking with the locking finger 135 of the closure member 133.

Conversely, as the slider device 160 is moved from the closed position to the open position, the spreader 174 engages the guide member 140 of the first closure profile 130 and biases the first closure profile 130 towards the first sidewall 162 in a direction away from the second closure profile 132. In particular, as can be seen in FIG. 9, the first angled wedge member 174*a* of the spreader 174 engages the guide member 140 of the first closure profile 130. Similarly, the spreader 174 engages the second closure profile 132 and biases the second closure profile towards the second sidewall 178 in a direction away from the first closure profile 130. In particular, the second angled wedge member 174*b* of the spreader 174 engages the upper flange 150 of the second closure profile 132. As a result of the spreader 174 forcing the first and second closure profiles 130, 132 away from each other, the closure member 133 disengages from the closure member 146. For example, as can be seen in FIG. 9, the locking finger 135 of the closure member 133 and the hook 148 are each deflected such that the closure member 133 is disengaged from the closure member 146. Accordingly, the first and second closure profiles 130, 132 can be disengaged, thereby opening the resealable closure mechanism 114.

As discussed above, it is typically undesireable for the slider device 160 to be removed from the flexible package 110. Hence, the slider 160 includes structure for preventing or minimizing the slider 160 being removed from the resealable closure mechanism 114. For example, as described above, the first sidewall 162 defines hook construction 165 extending from the first sidewall 162 about at or substantially near the distal end of the first sidewall 162. The hook construction 165 includes offset 169 that is constructed and arranged to engage the shoulder 134 in response to a pulling force on the slider device 160 away from said resealable closure mechanism 144. As a result, when a user intentionally or inadvertently attempts to remove the slider device 160 from the resealable closure mechanism 114 by pulling the slider device 160 away from the resealable closure mechanism 114, the hook construction 165 engages the shoulder 134 of the first closure profile 130 to reduce the likelihood that the slider device 160 can be removed from the resealable closure mechanism 114.

In addition to the structure described above, the first sidewall 162 also can include a sharp projection or barb member 190. The barb member 190 extends inwardly from the first sidewall 162 toward the second sidewall 178. In the particular embodiment shown in FIG. 9, the barb member 190 defines a triangular cross-section with a base 191 and a pair of sides 192, 193 ending in a point 194. The base 191 of the barb member 190 is arranged along the first sidewall 162. The pair of sides 192, 193 extend from the first sidewall 162 to project the point 194 towards the second sidewall 178. In particular, the pair of sides 192, 193 extend from the first sidewall 162 to project the point 194 towards the first closure profile 130.

Preferably, the barb member 190 extends inwardly from the first sidewall 162 of the slider device 160 at least about 0.04 inches (about 1 mm), no greater than about 0.20 inches (about 5 mm), typically about 0.06–0.16 inches (about 1.5–4 mm), and in a preferred embodiment about 0.08 inches (about 2 mm). The barb member 190 is substantially centered along the first sidewall 162 between the first end 170 and the second end 172 of the slider device 160. However, it should be understood that the barb member 190 can be positioned on the first sidewall 162 at any suitable location, for example, at or about near the first end 170 of the slider device 160 or, alternatively, at or about near the second end 172 of the slider device 160. Preferably, the barb member 190 has a width of at least about 0.04 inches (about 1 mm), no greater than about 0.12 inches (about 3 mm), typically about 0.06–0.10 inches (about 1.5–2.5 mm), and in a preferred embodiment about 0.08 inches (about 2 mm).

The barb member 190 is constructed and arranged to engage the first closure profile 130 when a user intentionally or inadvertently attempts to remove the slider device 160 from the resealable closure mechanism 114 by pulling the slider device 160 away from the resealable closure mechanism 114. In particular, the barb member 190 is constructed and arranged to engage the catch or hook 142 of the first closure profile 130 in response to a pulling force on the slider device 160 away from the resealable closure mechanism 114. For example, the catch or hook 142 is captured between the barb member 190 and the top wall 170. As a result, the barb member 190 aids in reducing the likelihood that the slider device 160 can be removed from the resealable closure mechanism 114.

The above specification and examples are believed to provide a complete description of the manufacture and use of particular embodiments of the invention. Many embodiments of the invention can be made without departing from the spirit and scope of the invention.

I claim:

1. A flexible package comprising:

(a) a package surrounding wall having a mouth providing access to a package interior;

(b) a resealable closure mechanism along said mouth for selective closing and opening of said mouth; said resealable closure mechanism including first and second closure profiles;

(i) said first and second closure profiles being constructed and arranged to interlock; and (c) a slider device operably mounted on said resealable closure mechanism for selectively closing and opening said resealable closure mechanism by moving said slider device relative to said resealable closure mechanism in opposite first and second directions; said slider device including:

(i) a top wall;

(ii) a first sidewall depending from said top wall; said first sidewall having a hook constriction to slidably cover said first closure profile; said first sidewall further having a barb member extending inwardly toward said first closure profile;

(A) said barb member being constructed and arranged to engage said first closure profile responsive to a pulling force on said slider device away from said resealable closure mechanism;

(iii) a second sidewall depending from said top wall opposite said first sidewall;

(A) said second sidewall defining a shoulder portion extending along said second sidewall from a first end of said slider device to a second end of said slider device; and (iv) said first and second sidewalls being tapered from said first end of said slider device to said second end of said slider device.

2. A flexible package comprising:

(a) a package surrounding wall having a mouth providing access to a package interior;

(b) a resealable closure mechanism along said mouth for selective closing and opening of said mouth; said resealable closure mechanism including first and second closure profiles;

(i) said first profile including a first closure member having a locking finger; a first upper flange; a guide member extending from said first upper flange; and a first catch extending from said first upper flange opposite said guide member; and (ii) said second profile including a second closure member having a second catch; a second upper flange; and a tongue member canitilevered from said second upper flange;

(iii) said locking finger and said second catch being constructed and arranged for selective interlocking;

(c) a slider device operably mounted on said resealable closure mechanism for selectively closing and opening said resealable closure mechanism by moving said slider device relative to said resealable closure mechanism in opposite first and second directions; said slider device including:

(i) a top wall; and (ii) a first sidewall depending from said top wall; said first sidewall having a hook construction to slidably cover said first closure profile; said first sidewall further having a barb member extending inwardly toward said first closure profile;

(A) said barb member being constructed and arranged to engage said first closure profile responsive to a pulling force on said slider device away from said resealable closure mechanism.

3. The flexible package according to claim 2, wherein:

(a) said barb member is constructed and arranged to engage said first catch of said first closure profile in response to a pulling force on said slider device away from said resealable closure mechanism.

4. The flexible package according to claim 2, wherein:

(a) said first profile further includes a shoulder between said first closure member and said first upper flange; and (b) said hook construction defining a flange to slidably cover said shoulder of said first closure profile;

(i) said flange defining an offset constructed and arranged to engage said shoulder of said first closure profile in response to a pulling force on said slider device away from said resealable closure mechanism.

5. The flexible package according to claim 2, wherein:

(a) said slider device further includes:

(i) a second sidewall depending from said top wall opposite said first sidewall; said second sidewall defining a slide channel for receiving said tongue member cantilevered from said second closure profile.

6. The flexible package according to claim 5, wherein:

(a) said slider device further includes:

(i) a spreader depending from said top wall for separating said first and second closure profiles;

(A) said spreader being constructed and arranged to bias said tongue member cantilevered from said first upper flange of said first closure profile towards said slide channel such that said tongue member is captured within said slide channel when said slider device is being removed from said resealable closure mechanism.

7. The flexible package according to claim 5, wherein:

(a) said slide channel of said second sidewall is oriented substantially proximate to said top wall of said slider device.

8. The flexible package according to claim 2, wherein:

(a) said guide member of said first upper flange biases said second closure member downwards into engagement with said first closure member.

9. A recloseable zipper arrangement, comprising:

(a) a first closure profile, said first profile including a first closure member having a locking finger; a first upper flange; a guide post extending from said first upper flange; and a first catch extending from said first upper flange opposite said guide post;

(b) a second closure profile, said second profile including a second closure member having a second catch; a second upper flange; and a tongue member cantilevered from said second upper flange;

(i) said locking finger and said second catch being constructed and arranged for selective interlocking; and (c) a slider device operably mounted on said first and second closure profiles for selectively closing and opening said resealable zipper arrangement by moving said slider device relative to said resealable zipper arrangement in opposite first and second directions; said slider device including:

(i) a top wall, said top wall of said slider device being mounted for slidable movement over said first and second upper flanges; and (ii) a first sidewall depending from said top wall; said first sidewall having a hook construction to slidably cover said first closure profile; said first sidewall further having a barb member extending inwardly toward said first closure profile;

(A) said barb member being constructed and arranged to engage said first closure profile responsive to a pulling force on said slider device away from said resealable zipper arrangement.

10. The recloseable zipper arrangement according to claim 9, wherein:

(a) said barb member is constructed and arranged to engage said first catch of said first closure profile responsive to a pulling force on said slider device away from said resealable zipper arrangement.

11. The recloseable zipper arrangement according to claim 9, wherein:

(a) said first profile further includes a shoulder between said first closure member and said first upper flange; and (b) said hook construction defining a flange to slidably cover said shoulder of said first closure profile;

(i) said flange defining an offset constructed and arranged to engage said shoulder of said first closure profile when said slider device is being removed from said resealable zipper arrangement.

12. The recloseable zipper arrangement according to claim 9, wherein:

(a) said slider device further includes:

(i) a second sidewall depending from said top wall opposite said first sidewall; said second sidewall defining a slide channel for receiving said tongue member cantilevered from said second closure profile.

13. The recloseable zipper arrangement according to claim 12, wherein:

(a) said slider device further includes:

(i) a spreader depending from said top wall for separating said first and second closure profiles;

(A) said spreader being constructed and arranged to bias said tongue member cantilevered from said first upper flange of said first closure profile towards said slide channel such that said tongue member is captured within said slide channel when said slider device is being removed from said recloseable zipper arrangement.

14. The recloseable zipper arrangement according to claim 13, wherein:

(a) said slide channel of said second sidewall is oriented substantially proximate to said top wall of said slider device.

15. A slider device for closing and opening interlocking closure members; said slider device comprising:

(a) a top wall; and (b) first and second sidewalls depending from said top wall; said first sidewall having a hook construction; said first sidewall further having a barb member extending inwardly toward said second sidewall;

(i) said barb member defining a triangular cross-section with a base and a pair of sides ending in a point; said base being along said first sidewall; said pair of sides extending from said first sidewall to project said point towards said second sidewall.

16. The slider device according to claim 15, wherein:

(a) said first and second sidewalls being tapered from a first end of said slider device to a second end of said slider device.

17. The slider device according to claim 15, wherein:

(a) said second sidewall defines a shoulder portion extending along said second sidewall from said first end of said slider device to said second end of said slider device.

18. The slider device according to claim 15, further comprising:

(a) a second sidewall depending from said top wall opposite said first sidewall; said second sidewall defining a slide channel.

19. The slider device according to claim 18 further comprising:

(a) a spreader depending from said top wall for separating said interlocking closure members;

(i) said spreader being constructed and arranged to bias said second interlocking closure member towards said slide channel such that said second interlocking closure member is captured within said slide channel.

20. The slider device according to claim 18, wherein:

(a) said slide channel of said second sidewall being arranged substantially proximate to said top wall of said slider device.

21. A method of using a resealable package comprising steps of:

(a) providing a package having a surrounding wall; a resealable mouth; and a resealable zipper arrangement with a slider device thereover for opening and rescaling the mouth; the slider device comprising:

(i) a top wall; and (ii) first and second sidewalls depending from the top wall; the first sidewall having a hook construction; the first sidewall further having a barb member extending inwardly toward the resealable zipper arrangement;

(A) the barb member being constructed and arranged to engage a first closure profile of the resealable zipper arrangement when the slider device is being removed from the resealable zipper arrangement; and (b) sliding a tongue member of a second closure profile along the resealable zipper arrangement in a first direction such that the tongue member of the second closure profile slides within a slide channel disposed in the second sidewall of the slider device to close the resealable zipper arrangement.

22. The method according to claim 21, said method further comprising the step of:

(a) moving the slider device along the resealable zipper arrangement in a second direction to open the resealable zipper arrangement.

* * * * *